US008742905B2

(12) United States Patent
Sekhri et al.

(10) Patent No.: US 8,742,905 B2
(45) Date of Patent: Jun. 3, 2014

(54) EASY TO USE AND INTUITIVE USER INTERFACE FOR A REMOTE CONTROL

(75) Inventors: Boualem Sekhri, Mississauga (CA); Barbara Glover, Toronto (CA); Alex Zaliauskas, Ontario (CA); Mathew Bates, Blackrock (IE)

(73) Assignee: Logitech Europe S.A., Lausanne (CH)

( * ) Notice: Subject to any disclaimer, the term of this patent is extended or adjusted under 35 U.S.C. 154(b) by 710 days.

(21) Appl. No.: 11/864,242

(22) Filed: Sep. 28, 2007

(65) Prior Publication Data

US 2008/0302582 A1 Dec. 11, 2008

Related U.S. Application Data

(63) Continuation of application No. 09/804,623, filed on Mar. 12, 2001, now abandoned.

(60) Provisional application No. 60/189,487, filed on Mar. 15, 2000.

(51) Int. Cl.
*G08C 19/16* (2006.01)

(52) U.S. Cl.
USPC ..... 340/12.5

(58) Field of Classification Search
USPC ..... 340/825.22, 10.1, 12.5, 5.61, 4.3; 345/173, 168
See application file for complete search history.

(56) References Cited

U.S. PATENT DOCUMENTS

| | | | |
|---|---|---|---|
| 3,597,531 | A | 8/1971 | De Marinis et al. |
| 3,990,012 | A | 11/1976 | Karnes |
| 4,174,517 | A | 11/1979 | Mandel |
| 4,231,031 | A | 10/1980 | Crowther et al. |
| 4,287,676 | A | 9/1981 | Weinhaus |
| 4,377,870 | A | 3/1983 | Anderson et al. |
| 4,392,022 | A | 7/1983 | Carlson |
| 4,394,691 | A | 7/1983 | Amano et al. |

(Continued)

FOREIGN PATENT DOCUMENTS

| | | |
|---|---|---|
| AU | 66267/90 | 4/1992 |
| AU | 200169851 A1 | 1/2002 |

(Continued)

OTHER PUBLICATIONS

Ciarcia, S., "Build a Trainable Infrared Master Controller," *Byte*, 12(3): 113-123 (1987).

(Continued)

*Primary Examiner* — Vernal Brown

(74) *Attorney, Agent, or Firm* — Kilpatrick Townsend & Stockton LLP

(57) ABSTRACT

A system and method for an easy to use and intuitive user interface on a remote control. In one embodiment, a touch sensitive area is extended beyond a screen. In one embodiment, soft buttons lie partially on the screen and partially off it (on the extended touch-sensitive area). This allows for an increased input area for the user, without the increase in cost associated with a larger screen. Moreover, this allows for a smooth, flat, and sleek upper surface of the remote control. In one embodiment, a remote control provides different user experiences based upon the context of use of the remote control. For instance, the color of the screen as well as the color of backlighting for certain buttons is dependent upon what mode the remote control is in.

23 Claims, 8 Drawing Sheets

(56) References Cited

U.S. PATENT DOCUMENTS 4,475,123 A 10/1984 Dumbauld et al.
4,488,179 A 12/1984 Kruger et al.
4,566,034 A 1/1986 Harger et al.
4,567,512 A 1/1986 Abraham
4,592,546 A 6/1986 Fascenda et al.
4,623,887 A 11/1986 Welles, II
4,626,848 A 12/1986 Ehlers
4,703,359 A 10/1987 Rumboldt et al.
4,706,121 A 11/1987 Young
4,712,105 A 12/1987 Kohler
4,728,949 A 3/1988 Platte et al.
4,746,919 A 5/1988 Reitmeier
4,774,511 A 9/1988 Rumbolt et al.
4,792,972 A 12/1988 Cook, Jr.
4,807,031 A 2/1989 Broughton et al.
4,825,200 A 4/1989 Evans et al.
4,825,209 A 4/1989 Sasaki et al.
4,837,627 A 6/1989 Mengel
4,845,491 A 7/1989 Fascenda et al.
4,857,898 A 8/1989 Smith
4,866,434 A 9/1989 Keenan
4,876,592 A 10/1989 Von Kohorn
4,888,709 A 12/1989 Revesz et al.
4,899,370 A 2/1990 Kameo et al.
4,918,439 A 4/1990 Wozniak et al.
4,941,090 A 7/1990 McCarthy
4,959,719 A 9/1990 Strubbe et al.
4,959,810 A 9/1990 Darbee et al.
RE33,369 E 10/1990 Hashimoto
4,962,466 A 10/1990 Revesz et al.
4,989,081 A 1/1991 Miyagawa et al.
4,999,622 A 3/1991 Amano et al.
5,001,554 A 3/1991 Johnson et al.
5,016,272 A 5/1991 Stubbs et al.
5,033,079 A 7/1991 Catron et al.
5,046,093 A 9/1991 Wachob
5,065,235 A 11/1991 Iijima
5,065,251 A 11/1991 Shuhart, Jr. et al.
5,089,885 A 2/1992 Clark
5,097,249 A 3/1992 Yamamoto
5,109,222 A 4/1992 Welty
5,115,236 A 5/1992 Kohler
5,117,355 A 5/1992 McCarthy
5,128,752 A 7/1992 Von Kohorn
5,132,679 A 7/1992 Kubo et al.
5,140,326 A 8/1992 Bacrania et al.
5,151,789 A 9/1992 Young
5,161,023 A 11/1992 Keenan
5,177,461 A 1/1993 Budzyna et al.
5,202,826 A 4/1993 McCarthy
5,204,768 A 4/1993 Tsakiris et al.
5,206,722 A 4/1993 Kwan
5,220,420 A 6/1993 Hoarty et al.
5,228,077 A 7/1993 Darbee
5,237,327 A 8/1993 Saitoh et al.
5,249,044 A 9/1993 Von Kohorn
5,251,048 A 10/1993 Doane et al.
5,255,313 A 10/1993 Darbee
5,272,418 A 12/1993 Howe et al.
5,282,028 A 1/1994 Johnson et al.
5,285,278 A 2/1994 Holman
5,287,181 A 2/1994 Holman
5,287,268 A 2/1994 McCarthy
5,297,204 A 3/1994 Levine
5,341,166 A 8/1994 Garr et al.
5,353,121 A 10/1994 Young et al.
5,355,480 A 10/1994 Smith et al.
5,367,316 A 11/1994 Ikezaki
5,374,999 A 12/1994 Chuang et al.
5,381,991 A 1/1995 Stocker
5,382,947 A 1/1995 Thaler et al.
5,404,393 A 4/1995 Remillard
5,406,558 A 4/1995 Rovira et al.
5,410,326 A 4/1995 Goldstein
5,414,426 A 5/1995 O'Donnell et al.
5,414,761 A 5/1995 Darbee
5,416,535 A 5/1995 Sato et al.
5,418,424 A 5/1995 Aprile et al.
5,422,783 A 6/1995 Darbee
5,446,551 A 8/1995 Kawaguchi et al.
5,450,079 A 9/1995 Dunaway
5,455,570 A 10/1995 Cook et al.
5,461,667 A 10/1995 Remillard
5,479,266 A 12/1995 Young et al.
5,479,268 A 12/1995 Young et al.
5,481,251 A 1/1996 Buys et al.
5,481,256 A 1/1996 Darbee et al.
5,483,276 A 1/1996 Brooks et al.
5,497,185 A 3/1996 Dufresne et al.
5,500,681 A 3/1996 Jones
5,500,794 A 3/1996 Fujita et al.
5,502,504 A 3/1996 Marshall et al.
5,504,475 A 4/1996 Houdou et al.
5,515,052 A 5/1996 Darbee
5,515,106 A 5/1996 Chaney et al.
5,517,254 A 5/1996 Monta et al.
5,523,794 A 6/1996 Mankovitz et al.
5,523,796 A 6/1996 Marshall et al.
5,524,141 A 6/1996 Braun et al.
5,524,195 A 6/1996 Clanton, III et al.
5,528,304 A 6/1996 Cherrick et al.
5,532,689 A 7/1996 Bueno
5,532,732 A 7/1996 Yuen et al.
5,532,754 A 7/1996 Young et al.
5,537,106 A 7/1996 Mitsuhashi
5,537,107 A 7/1996 Funado
5,537,463 A 7/1996 Escobosa et al.
5,539,393 A 7/1996 Barfod
5,552,837 A 9/1996 Mankovitz
5,552,917 A 9/1996 Darbee et al.
5,557,338 A 9/1996 Maze et al.
5,557,721 A 9/1996 Fite et al.
5,559,548 A 9/1996 Davis et al.
5,566,353 A 10/1996 Cho et al.
5,568,367 A 10/1996 Park
5,576,755 A 11/1996 Davis et al.
5,576,768 A 11/1996 Gomikawa
5,579,055 A 11/1996 Hamilton et al.
5,579,221 A 11/1996 Mun
5,583,491 A 12/1996 Kim
5,585,838 A 12/1996 Lawler et al.
5,585,866 A 12/1996 Miller et al.
5,589,892 A 12/1996 Knee et al.
5,592,551 A 1/1997 Lett et al.
5,596,373 A 1/1997 White et al.
5,600,573 A 2/1997 Hendricks et al.
5,603,078 A 2/1997 Henderson et al.
5,604,923 A 2/1997 Wilkus
5,614,906 A 3/1997 Hayes et al.
5,619,196 A 4/1997 Escobosa
5,619,251 A 4/1997 Kuroiwa et al.
5,625,608 A 4/1997 Grewe et al.
5,627,567 A * 5/1997 Davidson ..... 345/173
5,629,733 A 5/1997 Youman et al.
5,629,868 A 5/1997 Tessier et al.
5,631,652 A 5/1997 Lee
5,638,050 A 6/1997 Sacca et al.
5,638,113 A 6/1997 Lappington et al.
5,646,608 A 7/1997 Shintani
5,650,831 A 7/1997 Farwell
5,663,757 A 9/1997 Morales
5,671,267 A 9/1997 August et al.
5,677,711 A 10/1997 Kuo
5,684,526 A 11/1997 Yoshinobu
5,686,891 A 11/1997 Sacca et al.
5,689,353 A 11/1997 Darbee et al.
5,695,400 A 12/1997 Fennell, Jr. et al.
5,710,601 A 1/1998 Marshall et al.
5,710,605 A 1/1998 Nelson
5,734,838 A 3/1998 Robinson et al.
5,761,601 A 6/1998 Nemirofsky et al.
5,768,680 A 6/1998 Thomas
5,774,172 A 6/1998 Kapell et al.
5,778,256 A 7/1998 Darbee

(56) References Cited

U.S. PATENT DOCUMENTS 5,781,894 A 7/1998 Petrecca et al.
5,786,814 A 7/1998 Moran et al.
5,794,210 A 8/1998 Goldhaber et al.
5,796,832 A 8/1998 Kawan
5,800,268 A 9/1998 Molnick
5,806,065 A 9/1998 Lomet
5,815,086 A 9/1998 Ivie et al.
5,819,034 A 10/1998 Joseph et al.
5,819,294 A 10/1998 Chambers et al.
5,822,123 A 10/1998 Davis et al.
5,828,318 A 10/1998 Cesar et al.
5,828,945 A 10/1998 Klosteman
5,850,249 A 12/1998 Massetti et al.
5,855,008 A 12/1998 Goldhaber et al.
5,870,030 A 2/1999 Deluca et al.
5,870,683 A 2/1999 Wells
RE36,119 E 3/1999 Kunishima
5,883,680 A 3/1999 Nykerk
5,886,691 A 3/1999 Furuya et al.
5,907,322 A 5/1999 Kelly et al.
5,909,183 A 6/1999 Borgstahl et al.
5,923,016 A 7/1999 Fredregill et al.
5,940,073 A 8/1999 Klosterman et al.
5,943,228 A 8/1999 Kim
5,946,646 A 8/1999 Schena et al.
5,949,351 A 9/1999 Hahm
5,953,144 A 9/1999 Darbee et al.
5,959,751 A 9/1999 Darbee et al.
5,963,145 A 10/1999 Escobosa
6,002,443 A 12/1999 Iggulden
6,002,450 A 12/1999 Darbee et al.
6,008,802 A 12/1999 Iki et al.
6,014,092 A 1/2000 Darbee et al.
6,040,829 A 3/2000 Croy et al.
6,057,872 A 5/2000 Candelore
6,097,309 A 8/2000 Hayes et al.
6,097,441 A 8/2000 Allport
6,097,520 A 8/2000 Kadnier
6,104,334 A * 8/2000 Allport ..... 341/175
6,127,941 A 10/2000 Van Ryzin et al.
6,130,625 A 10/2000 Harvey
6,130,726 A 10/2000 Darbee et al.
6,133,847 A 10/2000 Yang
6,144,315 A 11/2000 Flick
6,144,375 A 11/2000 Jain et al.
6,147,677 A 11/2000 Escobosa et al.
6,154,204 A 11/2000 Thompson et al.
6,157,319 A 12/2000 Johns et al.
6,169,451 B1 1/2001 Kim
6,173,330 B1 1/2001 Guo et al.
6,177,931 B1 1/2001 Alexander et al.
6,195,033 B1 2/2001 Darbee et al.
6,198,479 B1 3/2001 Humpleman et al.
6,198,481 B1 * 3/2001 Urano et al. ..... 715/835
6,208,341 B1 3/2001 van Ee et al.
6,211,870 B1 4/2001 Foster
6,223,348 B1 4/2001 Hayes et al.
6,225,938 B1 5/2001 Hayes et al.
6,243,035 B1 6/2001 Walter et al.
6,255,961 B1 7/2001 Van Ryzin et al.
6,271,831 B1 8/2001 Escobosa et al.
6,275,268 B1 8/2001 Ellis et al.
6,278,499 B1 8/2001 Darbee
6,288,799 B1 9/2001 Sekiguchi
6,326,947 B1 12/2001 Capps et al.
6,330,091 B1 12/2001 Escobosa et al.
6,369,803 B2 * 4/2002 Brisebois et al. ..... 345/173
6,374,404 B1 4/2002 Brotz et al.
6,397,187 B1 5/2002 Vriens et al.
6,408,435 B1 6/2002 Sato
6,445,306 B1 9/2002 Trovato et al.
6,469,633 B1 * 10/2002 Wachter ..... 340/4.37
6,483,548 B1 11/2002 Allport
6,483,906 B1 11/2002 Iggulden et al.
6,496,135 B1 12/2002 Darbee
6,504,580 B1 1/2003 Thompson et al.
6,522,262 B1 2/2003 Hayes et al.
6,532,592 B1 3/2003 Shintani et al.
6,538,556 B1 3/2003 Kawajiri
6,563,430 B1 5/2003 Kemink et al.
6,567,011 B1 5/2003 Young et al.
6,567,984 B1 5/2003 Allport
6,587,067 B2 7/2003 Darbee et al.
6,628,340 B1 9/2003 Graczyk et al.
6,629,077 B1 9/2003 Arling et al.
6,640,144 B1 10/2003 Huang et al.
6,642,852 B2 11/2003 Dresti et al.
6,650,247 B1 11/2003 Hayes
6,657,679 B2 12/2003 Hayes et al.
6,690,290 B2 2/2004 Young et al.
6,690,392 B1 2/2004 Wugoski
6,701,091 B2 3/2004 Escobosa et al.
6,720,904 B1 4/2004 Darbee
6,722,984 B1 4/2004 Sweeney, Jr. et al.
6,724,339 B2 4/2004 Conway et al.
6,747,591 B1 6/2004 Lilleness et al.
6,748,248 B1 6/2004 Pan et al.
6,748,462 B2 6/2004 Dubil et al.
6,759,967 B1 7/2004 Staller
6,781,518 B1 8/2004 Hayes et al.
6,781,638 B1 8/2004 Hayes
6,784,804 B1 8/2004 Hayes et al.
6,784,805 B2 8/2004 Harris et al.
6,785,579 B2 8/2004 Huang et al.
6,788,241 B2 9/2004 Arling et al.
6,813,619 B2 11/2004 Devara
6,826,370 B2 11/2004 Escobosa et al.
6,828,992 B1 12/2004 Freeman et al.
6,829,512 B2 12/2004 Huang et al.
6,829,992 B2 12/2004 Kobayashi et al.
6,842,653 B2 1/2005 Weishut et al.
6,847,101 B2 1/2005 Ejelstad et al.
6,859,197 B2 2/2005 Klein et al.
6,862,741 B1 3/2005 Grooters
6,870,463 B2 3/2005 Dresti et al.
6,874,037 B1 3/2005 Abram
6,882,299 B1 4/2005 Allport
6,882,729 B2 4/2005 Arling et al.
6,885,952 B1 4/2005 Hayes et al.
6,917,302 B2 7/2005 Lilleness et al.
6,933,833 B1 8/2005 Darbee
6,938,101 B2 8/2005 Hayes et al.
6,946,988 B2 9/2005 Edwards et al.
6,947,101 B2 9/2005 Arling
6,968,570 B2 11/2005 Hayes et al.
6,980,150 B2 12/2005 Conway et al.
7,005,979 B2 2/2006 Haughawout et al.
7,009,528 B2 3/2006 Griep
7,010,805 B2 3/2006 Hayes et al.
7,013,434 B2 3/2006 Masters et al.
RE39,059 E 4/2006 Foster
7,046,161 B2 5/2006 Hayes
7,079,113 B1 7/2006 Hayes et al.
7,091,898 B2 8/2006 Arling et al.
7,093,003 B2 8/2006 Yuh et al.
7,102,688 B2 9/2006 Hayes et al.
7,119,710 B2 10/2006 Hayes et al.
7,126,468 B2 10/2006 Arling et al.
7,129,995 B2 10/2006 Arling
7,135,985 B2 11/2006 Woolgar et al.
7,136,709 B2 11/2006 Arling et al.
7,142,127 B2 11/2006 Hayes et al.
7,142,934 B2 11/2006 Janik
7,142,935 B2 11/2006 Janik
7,143,214 B2 11/2006 Hayes et al.
7,151,528 B2 12/2006 Taylor et al.
7,154,428 B2 12/2006 Clercq et al.
7,154,483 B2 * 12/2006 Kobayashi ..... 345/173
7,155,305 B2 12/2006 Hayes et al.
7,161,524 B2 1/2007 Nguyen
7,167,765 B2 1/2007 Janik
7,167,913 B2 1/2007 Chanmbers
7,193,661 B2 3/2007 Dresti et al.
7,200,357 B2 4/2007 Janik et al.

(56) References Cited

U.S. PATENT DOCUMENTS

| | | | |
|---|---|---|---|
| 7,209,116 | B2 | 4/2007 | Gates et al. |
| 7,218,243 | B2 | 5/2007 | Hayes et al. |
| 7,221,306 | B2 | 5/2007 | Young |
| 7,224,903 | B2 | 5/2007 | Colmenarez et al. |
| RE39,716 | E | 7/2007 | Huang et al. |
| 7,253,765 | B2 | 8/2007 | Edwards et al. |
| 7,254,777 | B2 | 8/2007 | Hayes et al. |
| 7,266,701 | B2 | 9/2007 | Hayes et al. |
| 7,266,777 | B2 | 9/2007 | Scott et al. |
| 7,268,694 | B2 | 9/2007 | Hayes et al. |
| 7,274,303 | B2 | 9/2007 | Dresti et al. |
| 7,281,262 | B2 | 10/2007 | Hayes et al. |
| 7,283,059 | B2 | 10/2007 | Harris et al. |
| 7,319,409 | B2 | 1/2008 | Hayes et al. |
| 7,319,426 | B2 | 1/2008 | Garfio |
| 7,436,319 | B1 | 10/2008 | Harris et al. |
| 7,574,693 | B1 | 8/2009 | Kemink |
| 7,590,999 | B2 | 9/2009 | Perlman |
| 7,612,685 | B2 | 11/2009 | Harris et al. |
| 7,746,244 | B2 | 6/2010 | Wouters |
| 7,889,095 | B1 | 2/2011 | Harris et al. |
| 7,944,370 | B1 | 5/2011 | Harris et al. |
| 8,026,789 | B2 | 9/2011 | Harris et al. |
| 8,098,140 | B1 | 1/2012 | Escobosa |
| 2001/0033243 | A1 | 10/2001 | Harris et al. |
| 2002/0008789 | A1 | 1/2002 | Harris et al. |
| 2002/0046083 | A1 | 4/2002 | Ondeck |
| 2002/0056084 | A1 | 5/2002 | Harris et al. |
| 2002/0151327 | A1 | 10/2002 | Levitt |
| 2002/0170073 | A1 | 11/2002 | Miller et al. |
| 2002/0184626 | A1 | 12/2002 | Darbee et al. |
| 2002/0190956 | A1 | 12/2002 | Klein et al. |
| 2002/0194410 | A1 | 12/2002 | Hayes et al. |
| 2003/0046579 | A1 | 3/2003 | Hayes et al. |
| 2003/0048295 | A1 | 3/2003 | Lilleness et al. |
| 2003/0095156 | A1 | 5/2003 | Klein et al. |
| 2003/0103088 | A1 | 6/2003 | Dresti et al. |
| 2003/0117427 | A1 | 6/2003 | Haughawout et al. |
| 2003/0151538 | A1 | 8/2003 | Escobosa et al. |
| 2003/0164773 | A1 | 9/2003 | Young et al. |
| 2003/0164787 | A1 | 9/2003 | Dresti et al. |
| 2003/0189509 | A1 | 10/2003 | Hayes et al. |
| 2003/0193519 | A1 | 10/2003 | Hayes et al. |
| 2003/0233664 | A1 | 12/2003 | Huang et al. |
| 2004/0046677 | A1 | 3/2004 | Dresti et al. |
| 2004/0056789 | A1 | 3/2004 | Arling et al. |
| 2004/0056984 | A1 | 3/2004 | Hayes et al. |
| 2004/0070491 | A1 | 4/2004 | Huang et al. |
| 2004/0093096 | A1 | 5/2004 | Huang et al. |
| 2004/0117632 | A1 | 6/2004 | Arling et al. |
| 2004/0136726 | A1 | 7/2004 | Escobosa et al. |
| 2004/0169590 | A1 | 9/2004 | Haughawout et al. |
| 2004/0169598 | A1 | 9/2004 | Arling et al. |
| 2004/0189508 | A1 | 9/2004 | Nguyen |
| 2004/0189509 | A1 | 9/2004 | Lilleness et al. |
| 2004/0210933 | A1 | 10/2004 | Dresti et al. |
| 2004/0246165 | A1 | 12/2004 | Conway et al. |
| 2004/0263349 | A1 | 12/2004 | Haughawout et al. |
| 2004/0266419 | A1 | 12/2004 | Arling et al. |
| 2004/0268391 | A1 | 12/2004 | Clercq et al. |
| 2005/0024226 | A1 | 2/2005 | Hayes et al. |
| 2005/0030196 | A1 | 2/2005 | Harris et al. |
| 2005/0052423 | A1 | 3/2005 | Harris et al. |
| 2005/0055716 | A1 | 3/2005 | Louie et al. |
| 2005/0062614 | A1 | 3/2005 | Young |
| 2005/0062636 | A1 | 3/2005 | Conway et al. |
| 2005/0066370 | A1 | 3/2005 | Alvarado et al. |
| 2005/0078087 | A1 | 4/2005 | Gates et al. |
| 2005/0080496 | A1 | 4/2005 | Hayes et al. |
| 2005/0088315 | A1 | 4/2005 | Klein et al. |
| 2005/0094610 | A1 | 5/2005 | de Clerq et al. |
| 2005/0096753 | A1 | 5/2005 | Arling et al. |
| 2005/0097594 | A1 | 5/2005 | O'Donnell et al. |
| 2005/0097618 | A1 | 5/2005 | Arling et al. |
| 2005/0107966 | A1 | 5/2005 | Chung |
| 2005/0116930 | A1 | 6/2005 | Gates |
| 2005/0134578 | A1 | 6/2005 | Chambers et al. |
| 2005/0159823 | A1 | 7/2005 | Hayes et al. |
| 2005/0162282 | A1 | 7/2005 | Dresti et al. |
| 2005/0179559 | A1 | 8/2005 | Edwards et al. |
| 2005/0183104 | A1 | 8/2005 | Edwards et al. |
| 2005/0195979 | A1 | 9/2005 | Arling et al. |
| 2005/0200598 | A1 | 9/2005 | Hayes et al. |
| 2005/0210101 | A1 | 9/2005 | Janik |
| 2005/0216606 | A1 | 9/2005 | Hayes et al. |
| 2005/0216843 | A1 | 9/2005 | Masters et al. |
| 2005/0231649 | A1 | 10/2005 | Arling |
| 2005/0258806 | A1 | 11/2005 | Janik et al. |
| 2005/0280743 | A1 | 12/2005 | Dresti et al. |
| 2005/0283814 | A1 | 12/2005 | Scott et al. |
| 2005/0285750 | A1 | 12/2005 | Hayes et al. |
| 2006/0007306 | A1 | 1/2006 | Masters et al. |
| 2006/0012488 | A1 | 1/2006 | Hilbrink et al. |
| 2006/0031400 | A1 | 2/2006 | Yuh et al. |
| 2006/0031437 | A1 | 2/2006 | Chambers |
| 2006/0031549 | A1 | 2/2006 | Janik et al. |
| 2006/0031550 | A1 | 2/2006 | Janik et al. |
| 2006/0050142 | A1 | 3/2006 | Scott et al. |
| 2006/0055554 | A1 | 3/2006 | Hayes et al. |
| 2006/0101498 | A1 | 5/2006 | Arling et al. |
| 2006/0125800 | A1 | 6/2006 | Janik |
| 2006/0132458 | A1 | 6/2006 | Garfio et al. |
| 2006/0143572 | A1 | 6/2006 | Scott et al. |
| 2006/0150120 | A1 | 7/2006 | Dresti et al. |
| 2006/0161865 | A1 | 7/2006 | Scott et al. |
| 2006/0192855 | A1 | 8/2006 | Harris et al. |
| 2006/0194549 | A1 | 8/2006 | Janik et al. |
| 2006/0200538 | A1 | 9/2006 | Yuh et al. |
| 2006/0259183 | A1 | 11/2006 | Hayes et al. |
| 2006/0259184 | A1 | 11/2006 | Hayes et al. |
| 2006/0259864 | A1 | 11/2006 | Klein et al. |
| 2006/0262002 | A1 | 11/2006 | Nguyen |
| 2006/0283697 | A1 | 12/2006 | Garfio |
| 2006/0288300 | A1 | 12/2006 | Chambers et al. |
| 2006/0294217 | A1 | 12/2006 | Chambers |
| 2007/0037522 | A1 | 2/2007 | Liu et al. |
| 2007/0052547 | A1 | 3/2007 | Haughawout et al. |
| 2007/0061027 | A1 | 3/2007 | Janik |
| 2007/0061028 | A1 | 3/2007 | Janik |
| 2007/0061029 | A1 | 3/2007 | Janik |
| 2007/0063860 | A1 | 3/2007 | Escobosa et al. |
| 2007/0073958 | A1 | 3/2007 | Kalayjian |
| 2007/0077784 | A1 | 4/2007 | Kalayjian et al. |
| 2007/0097275 | A1 | 5/2007 | Dresti et al. |
| 2007/0136693 | A1 | 6/2007 | Lilleness et al. |
| 2007/0156739 | A1 | 7/2007 | Black et al. |
| 2007/0178830 | A1 | 8/2007 | Janik et al. |
| 2007/0206949 | A1 | 9/2007 | Mortensen |
| 2007/0225828 | A1 | 9/2007 | Huang et al. |
| 2007/0233740 | A1 | 10/2007 | Nichols et al. |
| 2007/0258595 | A1 | 11/2007 | Choy |
| 2007/0271267 | A1 | 11/2007 | Lim et al. |
| 2007/0279244 | A1 | 12/2007 | Haughawout et al. |
| 2007/0296552 | A1 | 12/2007 | Huang et al. |
| 2008/0005764 | A1 | 1/2008 | Arling et al. |
| 2008/0016467 | A1 | 1/2008 | Chambers et al. |
| 2008/0016468 | A1 | 1/2008 | Chambers et al. |
| 2008/0036642 | A1 | 2/2008 | Harris et al. |
| 2008/0042982 | A1 | 2/2008 | Gates et al. |
| 2008/0062033 | A1 | 3/2008 | Harris et al. |
| 2008/0062034 | A1 | 3/2008 | Harris et al. |
| 2008/0068247 | A1 | 3/2008 | Harris et al. |
| 2008/0198059 | A1 | 8/2008 | Harris et al. |
| 2009/0224955 | A1 | 9/2009 | Bates et al. |
| 2010/0033638 | A1 | 2/2010 | O'Donnell |
| 2011/0133976 | A1 | 6/2011 | Harris et al. |
| 2012/0326852 | A1 | 12/2012 | Harris et al. |

FOREIGN PATENT DOCUMENTS

| | | | |
|---|---|---|---|
| CA | 2092003 | A1 | 11/2008 |
| CN | 1399444 | A | 2/2003 |
| CN | 1434422 | A | 8/2003 |
| DE | 19520754 | A1 | 12/1996 |

(56) References Cited

FOREIGN PATENT DOCUMENTS

| | | | |
|---|---|---|---|
| EP | 103 438 | A1 | 3/1984 |
| EP | 0103438 | A1 | 3/1984 |
| EP | 0398 550 | A2 | 11/1990 |
| EP | 0972280 | A1 | 1/2000 |
| EP | 1014577 | A1 | 6/2000 |
| EP | 1198069 | B1 | 4/2002 |
| EP | 1777830 | A1 | 4/2007 |
| FR | 2738931 | A1 | 3/1997 |
| GB | 2081948 | A | 2/1982 |
| GB | 2175724 | A | 12/1986 |
| GB | 2304217 | A | 3/1997 |
| JP | 7075173 | A | 3/1995 |
| JP | 7112301 | B | 11/1995 |
| JP | 2002058079 | A | 2/2002 |
| JP | 2002271871 | A | 9/2002 |
| JP | 2003087881 | A | 3/2003 |
| MX | PA/2003000322 | A | 11/2003 |
| WO | WO 01/69567 | A2 | 9/1991 |
| WO | WO 93/12612 | A1 | 6/1993 |
| WO | WO 93/19427 | A1 | 9/1993 |
| WO | WO 94/15417 | A1 | 7/1994 |
| WO | WO 95/01056 | A1 | 1/1995 |
| WO | WO 95/01057 | A1 | 1/1995 |
| WO | WO 95/01058 | A1 | 1/1995 |
| WO | WO 95/01059 | A1 | 1/1995 |
| WO | WO 95/32563 | A1 | 11/1995 |
| WO | WO 95/32583 | A1 | 11/1995 |
| WO | 9628903 | A1 | 9/1996 |
| WO | WO 96/30864 | A1 | 10/1996 |
| WO | WO 97/33434 | A1 | 9/1997 |
| WO | WO 98/43158 | A | 10/1998 |
| WO | WO 98/44477 | A1 | 10/1998 |
| WO | WO 99/04568 | A1 | 1/1999 |
| WO | WO 99/34564 | A1 | 7/1999 |
| WO | WO 00/34851 | A1 | 6/2000 |
| WO | WO 03/044684 | A1 | 5/2003 |
| WO | WO 03/045107 | A1 | 5/2003 |
| WO | WO 03/060804 | A1 | 7/2003 |
| WO | WO 03/100553 | A2 | 12/2003 |

OTHER PUBLICATIONS

Ciarcia, S., *The Best of Ciarcia's Circuit Cellar*, pp. 345-354 (1987).

Konstan, J. A., "State problems in programming human-controlled devices," *Digest of Tech. Papers of Int Conf. on Consumer Electronics* (*ICCE*), pp. 122-123 (1994).

Press Release: "Philipis Revolutionizes Home Theatre Control"; 1998, 3 pages.

"ProntoEdit User Manual"; 2002, http://www.pronto.philips.com/index.cfm?id=241, 85 pages.

"Pronto Review"; www.remotecentral.com/pronto/index.html, 3 pages.

Pronto link to downloadable files for components from different manufacturers; http://www.remotecentral.com/files/index.html, 3 pages.

Radio Shack, *Universal Remote Control Owners Manual*, pp. 1-19, (1987).

International Search Report for PCT/CA01/00323 mailed on Apr. 4, 2002; 7 pages.

* cited by examiner

EASY TO USE AND INTUITIVE USER INTERFACE FOR A REMOTE CONTROL

CROSS-REFERENCE TO RELATED APPLICATIONS

This application relates to co-pending application Ser. No. 11/199,922, entitled "Method and Apparatus for Uploading and Downloading Remote Control Codes" filed on Aug. 8, 2005, and is a continuation of application Ser. No. 09/804,623 filed Mar. 12, 2001, now abandoned which claims the benefit of provisional application No. 60/189,487 filed Mar. 15, 2000. These applications are herein incorporated by reference in their entirety.

This application relates to co-pending application Ser. No. 10/839,970, entitled "Online Remote Control Configuration System", filed on May 5, 2004, and is a continuation of application Ser. No. 09/804,623 filed Mar. 12, 2001, which claims the benefit of provisional application No. 60/189,487 filed Mar. 15, 2000. These applications are herein incorporated by reference in their entirety.

BACKGROUND OF THE INVENTION

1. Field of the Invention

This invention relates generally to an improved user interface, and more particularly, to an easy to use and intuitive user interface for remote controls.

2. Description of the Related Art

Home entertainment systems are becoming increasingly complex. A representative user will often have a TV, a DVD player, a VCR, a stereo receiver, and so on as part of his home entertainment system. Using multiple remotes, each specific to a particular appliance, is very cumbersome and inconvenient to a user. A complicated sequence of multiple button presses on multiple remote controls is often needed for the user to accomplish a simple task.

To address this problem, universal remote controls have become available on the market. Such universal remote controls can control several devices. While such remote controls manage to reduce the clutter associated with multiple device-specific remote controls, they are still inconvenient to use. Most such universal remote controls have a button for each device, which needs to be pressed before that device can be operated. For instance, a user may need to press a "TV" button, and then the "power" button on the remote control to turn on the TV, then press a "Receiver" button, and then the "power" button on the remote control to turn on the stereo receiver. The user would also need to select the correct mode for the stereo receiver to provide audio from the DVD player to the speakers. Next, the user would need to press a "DVD" button, and then the "power" button on the remote control to turn on the DVD player. The play button can be used to start playing the DVD. For simple things such as increasing the volume on the receiver, the user would need to press the "Receiver" button again before pressing the "Volume" button. It can be seen that albeit with one universal remote control, numerous steps still need to be taken by the user for even very simple activities.

Another evolution in remote controls emerged in response to this need. Such remote controls were activity based remote controls, which permitted users to configure simple activities such as "Watching TV", "Watching a DVD" etc., based on the particular configuration of their home entertainment systems, and then to simply select the desired activity. Examples of such remote controls are the Harmony® remotes from Logitech, Inc. (Fremont, Calif.), the assignee of the present invention.

As more and more sophisticated functionality gets included in a single remote, there is a need to provide the users with more options on the remote. One way in which this is handled is by including additional hard buttons on the remote control. In light of the desire for a small and compact form factor for remote controls, this leads to increased clutter on the remote control, as well as to increased user confusion in dealing with numerous buttons. Further, all such buttons are not useable at all times, but it is not clear to the user which buttons are useable at any given time. Moreover, numerous buttons on a remote control take away from a sleek and flat form factor, which is becoming increasingly important to users. Another way in which this is handled is by having an LCD screen displaying choices to the user, but the remote control then needs additional buttons to select/navigate through those choices, thus leading to further clutter on the remote control. A touch screen has been used in some cases, but this either results in clutter and confusion on the screen, or in a larger LCD which leads in turn to increased cost. Moreover, existing touch screens do not provide a smooth, flat look for the control device. Also, existing remotes with touch screens and/or soft buttons are not easy and intuitive to configure.

There is thus a need for a more intuitive and easy to configure and use user interface on remote controls. Further there is a need for such an interface without increased user confusion and without increased cost. Moreover, there is need for a user interface where users have some indication regarding the use of various modes/buttons. Further still, there is a need for a user interface that allows for a flat, smooth and sleek form factor for the remote control.

BRIEF SUMMARY OF THE INVENTION

The present invention is a system and method for an intuitive and easy to configure and use user interface (UI) on a remote control. A device in accordance with some embodiments of the present invention overall simplifies the user's experience.

In one embodiment of the present invention, a touch sensitive area is extended beyond a screen. In one embodiment, soft buttons lie partially on the screen and partially off it (on the extended touch-sensitive area). This allows for an increased input area for the user, without the increase in cost associated with a larger screen. Moreover, this allows for a smooth, flat, and sleek upper surface of the remote control. The mapping/functionality of the soft buttons is downloaded, in one embodiment, from a remote database.

In one embodiment of the present invention, a remote control provides different user experiences based upon the context of use of the remote control (e.g., which mode the remote control is in). For instance, a remote control may have different modes, such as an activity mode, a device mode, and an options/settings mode. The activity mode may allow a user to select from one of several preconfigured activities, such as watching TV, watching a DVD, listening to music, etc. The device mode may allow a user to select a particular device to control, such as the TV, the DVD player, the stereo receiver, the DVR (Digital Video Recorder), and so on. In accordance with an embodiment of the device mode, from the device mode, a user can access all the commands associated with a specific device, as compared to the activity mode, where only the most applicable commands for a device are displayed. The settings mode may allow a user to change specific settings, the configurations of various activities, and so on. One of the modes of the remote control (e.g., the activity mode) may be a desired or default mode of the remote control, while another mode (e.g., the device mode) may not be favored. In accordance with an embodiment of the present invention, the user interface can provide the user with cues/indications regarding this. In one embodiment, an undesired mode has an amber colored screen, while a desired mode has a blue colored screen. Additionally, certain soft and/or hard buttons may be backlit differently when in different modes. Such context-dependent visual cues prevent user confusion, and leads to increased clarity for the user about what he/she is doing.

In one embodiment of the present invention, the user is provided with an indication of when certain buttons and/or other areas of the user interface are useable. For instance, the functionality associated with certain buttons may not be available in a specific mode, or when in a specific menu. In such a situation, in accordance with an embodiment of the present invention, some indication is provided to the user regarding when the buttons (or other areas of the user interface) are useable. For instance, in one embodiment, a button has a lit-up white bar under its label only when the button is useable. Again, this provides increased clarity to the user regarding his options, and reduces user confusion.

The features and advantages described in this summary and the following detailed description are not all-inclusive, and particularly, many additional features and advantages will be apparent to one of ordinary skill in the art in view of the drawings, specification, and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

BRIEF DESCRIPTION OF THE DRAWINGS

The invention has other advantages and features which will be more readily apparent from the following detailed description of the invention and the appended claims, when taken in conjunction with the accompanying drawing, in which:

DETAILED DESCRIPTION OF THE INVENTION

The figures (or drawings) depict a preferred embodiment of the present invention for purposes of illustration only. It is noted that similar or like reference numbers in the figures may indicate similar or like functionality. One of skill in the art will readily recognize from the following discussion that alternative embodiments of the structures and methods disclosed herein may be employed without departing from the principles of the invention(s) herein.

Figure 1:
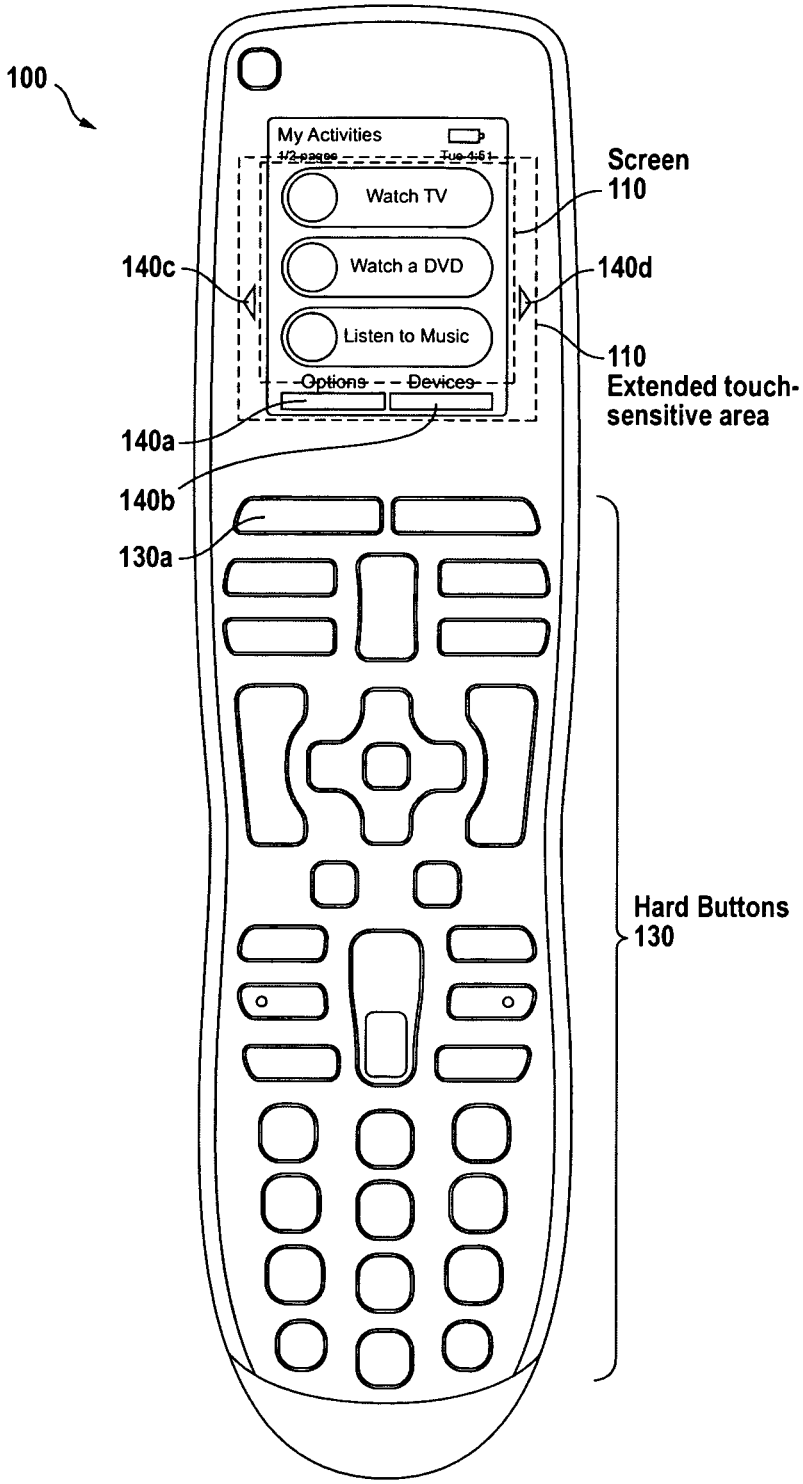
FIG. 1 shows a remote control in accordance with an embodiment of the present invention.

FIG. 1 shows a remote control 100 in accordance with an embodiment of the present invention. The remote control includes a screen 110, an extended touch-sensitive area 120 including some soft buttons, and several hard buttons 130.

The screen 110 (denoted by the smaller dashed rectangle) is sensitive to a user's touch. The screen can use any display technology, and can be, for example, a Liquid Crystal Display (LCD). The user can touch any of the options, such as "Watch TV" to trigger the action corresponding to that option.

In accordance with an embodiment of the present invention, the touch-sensitive area 120 (denoted by the larger dashed rectangle) extends beyond the screen 110. This can be seen clearly in FIG. 2A.

Figure 2A:
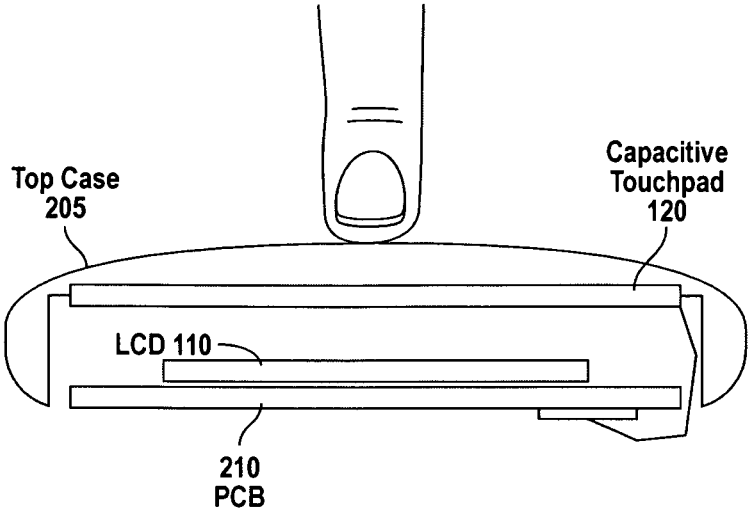
FIG. 2A shows the various layers associated with the touch sensitive area in a remote control in accordance with an embodiment of the present invention.

FIG. 2A shows the various layers associated with the touch sensitive area 120 in accordance with an embodiment of the present invention. The top case 205 of the remote control covers the touch-sensitive area 120. In one embodiment, the part of the top case 205 that is covering the screen 110 is transparent (or translucent), so as to make the screen 110 visible to the user. This transparent (or translucent) part acts as a lens covering the screen 110. In one embodiment, the touch-sensitive area 120 is coupled to the underside of the lens/top case 205. In one embodiment, the touch-sensitive area 120 is glued to the underside of the lens/top case 205. The touch-sensitive area 120 can be based on any touch sensing technology. In the embodiment shown in FIG. 2A, capacitive touch-sensitive technology is implemented. An example of such touch-sensitive technology is implemented in various products from Synaptics (Santa Clara, Calif.), such as a TouchPad. In such an embodiment, the touch-sensitive area 120 is responsive to the user's touch, and localized pressure (such as with a stylus) is not necessary. In some such embodiments, the touch-sensitive area 120 has a form factor which permits integration with the other components (such as the LCD 110 and the PCB 210) to provide a smooth upper surface of the remote control 100. In some embodiment, with capacitive touch-sensitive technology, the user does not need to touch the touch-sensitive area directly—rather, he/she can simply touch the top case 205 (and/or the lens area of the top case 205).

Figure 2B:
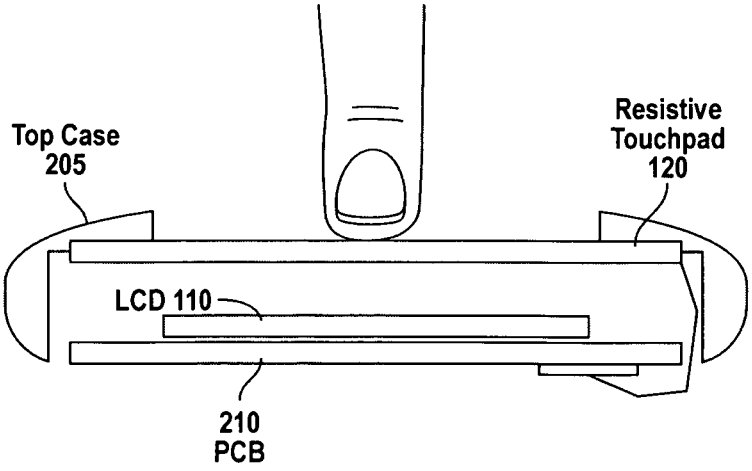
FIG. 2B shows the touch sensitive area in a remote control employing resistive technology.

FIG. 2B illustrates an embodiment with a touch-sensitive area employing resistive technology. For some embodiments employing resistive touch-sensitive technology, the touch-sensitive area 120 cannot be covered by the top case 205, since the user's finger (or other touch modalities such as a stylus) needs to press on the touch-sensitive area 120. As a result, the top case 205 has a hole cut in it as seen in it, as can be seen in FIG. 2B. However, this takes away from the smooth, sleek and flat look that is often desired by users.

Below the touch-sensitive area 120 is the screen/LCD 110. It can be seen clearly from FIG. 2A that the area of the touch-sensitive area 110 is larger than the area of the LCD 110. The LCD 110 is, in turn, coupled to the PCB 210 placed underneath it.

Having a touch-sensitive area larger than the screen is advantageous for at least the following reasons. Having a touch-sensitive area 120 larger than the screen 110 allows for a smaller LCD (than if the LCD had been as large as the touch-sensitive area). Since the size of an LCD impacts cost, having a relatively smaller LCD implies a reduction in cost. Without the increased expense associated with a larger LCD, the larger touch-sensitive area provides for additional area where the user can provide his or her input. Such extended touch-sensitive areas also allow for soft buttons that whose functionality and labels can be changed easily. Furthermore, touch-sensitive soft buttons provide for a much smoother, flatter and sleeker top surface of the remote control 100, than is possible with traditional solutions (such as having buttons operating mechanical switches under changeable labels on an LCD).

Below the touchpad 120 is a Printed Circuit Board (PCB) 210. The PCB 210 can more generally be any substrate that can be used to mechanically support and electrically connect electronic components using conductive pathways. It can be seen from FIG. 2A that the LCD 110 is coupled to the PCB 210. In one embodiment, the touch-sensitive area 120 is also connected to the PCB 210 via a connector (e.g., FPC). It will be obvious to one of skill in the art that several other components (e.g., processors) will be included (not shown).

Referring again to FIG. 1, it can be seen that there are two soft buttons 140*a*, 140*b*. The labels for these soft buttons 140*a* & 140*b* are on the LCD 110. In FIG. 1, these labels are "Options" and "Devices" respectively. There are several notable features about these soft buttons 140*a* & 140*b*. First, these labels as well as the presentation of the buttons themselves can vary depending upon specific implementations, and also depending upon the specific mode, or stage within a mode, in which the remote control 100 is at any given time. In some modes and/or levels within a mode, one or more of these soft buttons may not have any functionality. In such a situation, there is no label visible for the soft button in one embodiment of the present invention. Not having a label when a particular soft button cannot be operated provides the user with visual cues regarding what buttons he can/cannot use, and prevents user confusion.

Further, in one embodiment, these buttons are distributed across the LCD 110 and the touch-sensitive area 120 extending beyond the LCD. In one embodiment, the labels are on the LCD, while the lines underneath the labels (which can be seen in FIG. 1) are not on the LCD. In another embodiment, both the label and the white line underneath it are on the LCD 110, but the soft button itself extends under the LCD 110, so that the user's finger can be outside of the LCD and the soft button can still be operated.

Another notable feature about these soft buttons is the backlighting of the buttons, their labels, and the lines (or bars) underneath the labels. This is discussed in greater detail with reference to FIG. 5.

Two other soft buttons 140*c* and 140*d* can also be seen in FIG. 1. In one embodiment, soft buttons 140*c* and 140*d* do not have any labels, but are represented instead by a left arrow and a right arrow respectively. In one embodiment, these arrows are on the LCD 110. In such a situation, these arrows can be changed to any other label (textual and/or symbolic) as needed. In another embodiment, these arrows are not on the LCD. The arrow symbols are only examples, and any other text and/or symbols can be used.

As mentioned above in the context of the other soft buttons, soft buttons 140*c* and 140*d* also provide visual indications to the user regarding their functionality. As one example, when one or more of these buttons is not useable, the corresponding arrow symbol itself may not be visible. In another embodiment, when one or more of these buttons is not useable, the button is not backlit. In one embodiment, soft buttons 140*c* and 140*d* provide the functionality of "Previous Page" and "Next Page" respectively. When there is no previous page to view, the arrow associated with 140*c* will not be visible in one embodiment. When there is no next page to view, the arrow associated with 140*d* will not be visible in one embodiment. In another embodiment, when there is no previous page (or next page) to view, the arrow associated with 140*c* (or 140*d*) is shown in dotted lines. In another embodiment, the pages are circularly linked, such that when the user is on the first page, pressing the "Previous Page" button will take the user to the last page, and when the user is on the last page, pressing the "Next Page" button will take the user to the first page. In such an embodiment, both the arrows are visible even on the first and last pages. Such visual indications guide the user and simplify the usage of the remote by decreasing user confusion. As mentioned above, in one embodiment, the backlighting of such soft buttons 140*c* and 140*d* can be used to provide the user with visual cues. This is discussed further below with reference to FIG. 5.

Figure 3:
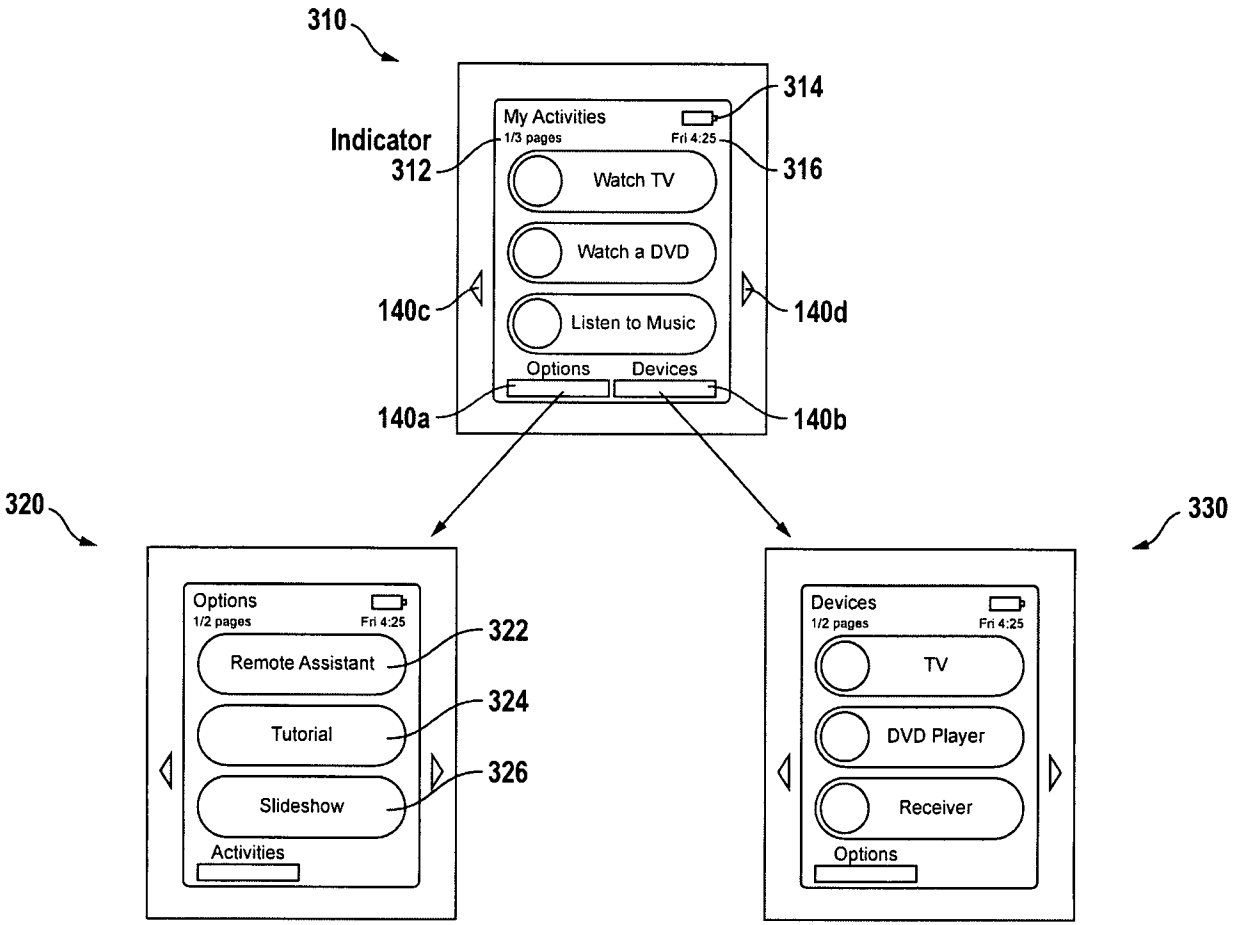
FIG. 3 illustrates the display on the LCD in accordance with an embodiment of the present invention when the hard button labeled "Activities" is pressed on the remote control.

FIG. 3 illustrates a screen 310 which illustrates the display on the LCD 110 in accordance with an embodiment of the present invention when the hard button labeled "Activities" 130*a* on the remote control 100 is pressed. Various activities created by the user, such as "Watch TV", "Watch a DVD", "Listen to Radio" etc. are shown on the LCD 110. If additional activities (e.g., "Play CD", "Watch VCR" etc.) are configured by the user and these do not fit on the first page of the display 110, then the user can see these activities (not shown) by pressing the next page button 140*d*. The specific page being displayed out of the total no. of pages available is displayed on the screen 110 as indicator 312. It can be seen from FIG. 3 that this page is showing the first of 3 pages. In one embodiment, if there is only one page, this indicator 312 will be removed. In one embodiment, a battery life indicator 314 is also displayed. In one embodiment, a day or date and time indicator 316 is also displayed. In FIG. 3, soft button 140*a* has the label "Options" and soft button 140*b* has the label "Devices". While the embodiment shown in FIG. 3 shows a broad white bar underneath the label, in other embodiments, there may simply be a narrower white line underneath the label as shown in FIG. 1. In still other embodiments, there may not be anything underneath the label at all. It will be obvious to one of skill in the art that the representation of the soft button (and its label) can be varied.

In one embodiment, selecting "Options" 140*a* shows on the display 320 the functions available for adjusting the remote control 100. In the embodiment shown, the functions available for adjusting the remote control 100 are "Remote Assistant" 322, "Tutorial" 324 and "SlideShow" 326. In one embodiment, the "Remote Assistant" 322 provides additional assistance to the user when they start and stop an activity. For instance, the Remote Assistant 322 may ask a user if he/she successfully turned on the Watch TV activity and asks the user to press help if there was a problem. In one embodiment, pressing "Tutorial" 324 results in the display of a short step by step tutorial on the LCD 110 regarding how to use the remote control. In one embodiment, pressing the "SlideShow" 326 button results in the display of a slideshow of user uploaded images on the remote control's LCD 110. It can be seen that soft button 140*a* is now labeled "Activities" and has the function of taking the user back to the Activities screen 310. It can also be seen that soft button 140*b* is no longer available on this screen 320. The label, as well as the line underneath it, are no longer visible. As mentioned above in the context of screen 310, this screen too can be distributed across multiple pages. For instance, other options can include "Date & Time" and "Remote Sound On/Off".

Selecting "Devices" 140*b* will take the user to the screen 330. This screen displays the user's devices, such as "TV", "DVD player", "Receiver" etc. Once again, the information may be distributed across multiple pages. This screen 330 can be used by the user to individually control any one of his various devices. Here, the soft button 140*a* is again configured to take the user back to the "Activities" screen 310, while the other soft button 140*b* is not usable and so is not visible. In other embodiments, soft buttons 140*a-d* provide different visual cues to the user when they are not usable, such as those discussed with reference to FIG. 5.

Figure 4A:
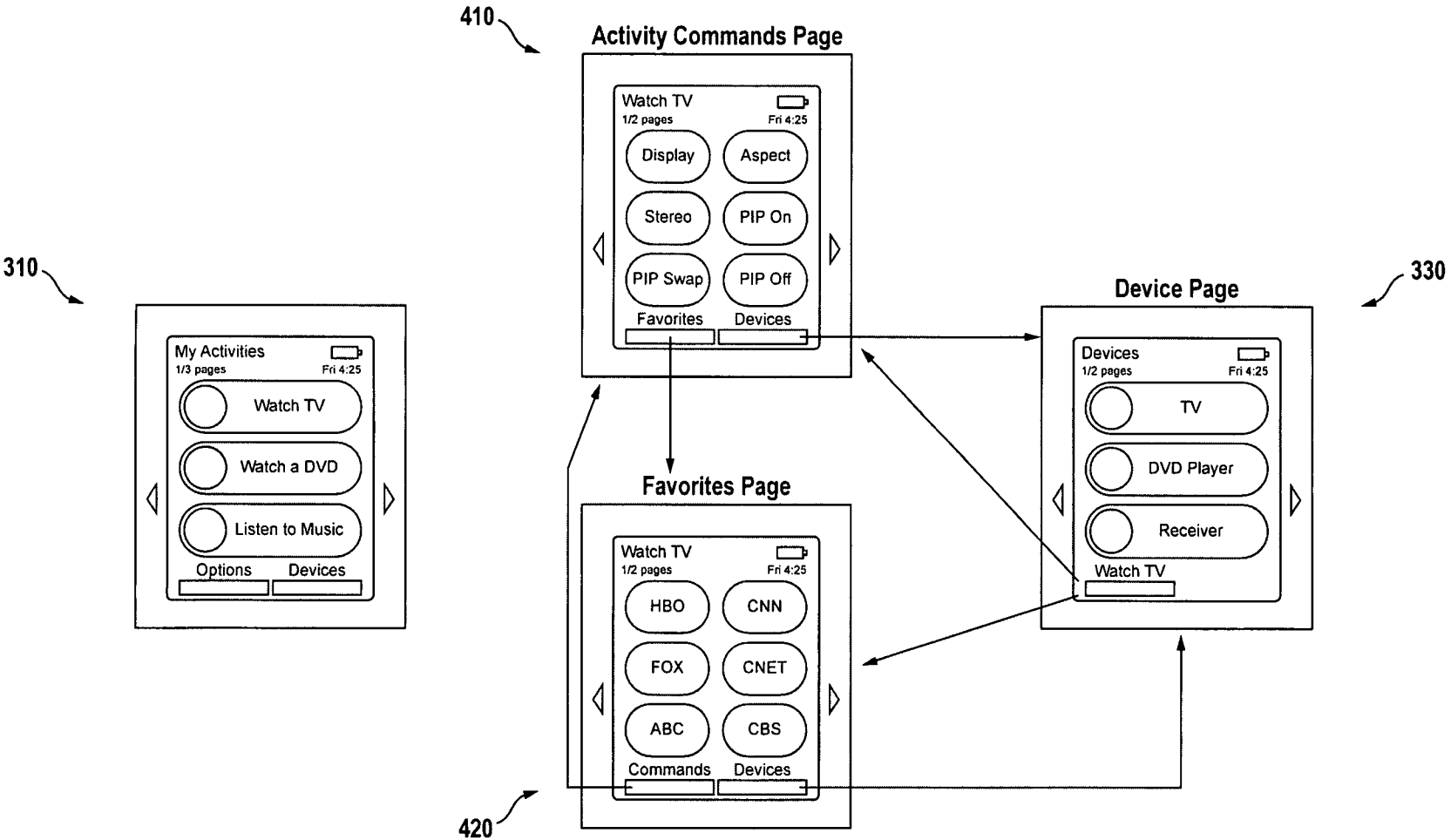
FIG. 4A shows some screens the user can go to from the "Activities" screen in one embodiment of the present invention.

Referring again to 310, selecting any activity will further lead to choices relating to that activity. For instance, FIG. 4A shows some screens the user can go to from the "Activities" screen 310 in one embodiment of the present invention. If the user selects the "Watch TV" activity, functions relating to the "Watch TV" activity are visible. In one embodiment, the user will be taken either to commands screen 410, or favorites screen 420, depending on the page setup by the user as the default. In screen 410, various commands/functions can be seen, which include "Display", "Aspect", "Stereo", "PIP On", "PIP off", and "PIP Swap". It is to be noted that in one embodiment, the particular functions displayed depend on the user's configuration of the home entertainment system using the configuration web-site, and can depend on various factors, such as the particular devices added to the account. As mentioned above, there can be more than one page displaying such functions, and the next page can be accessed, in one embodiment, by using soft button 140*d*.

Soft button 140*a* is labeled "Favorites" in screen 410, and selecting that button will show the favorite channels selected by a user in accordance with an embodiment of the present invention. This can be seen on screen 420. As mentioned above, screen 420 can also be accessed directly from screen 310 in accordance with an embodiment of the present invention. Screen 410 can be reached from screen 420 by clicking on the "Commands" soft button 140*a*. It can be seen from FIG. 4A that selecting the "Devices" soft button 140*b* on both screens 410 and 420 takes the user to the devices screen 330. In one embodiment, screen 330 in this case has a "Watch TV" soft button 140*a*, which will take the user to screen 410 or screen 420 depending on the user's default setup.

In one embodiment, if the user has no favorites selected, then the soft button 140*a* will not be usable and/or visible in screen 410. In one embodiment, the soft button 140*a* will be different depending upon which activity is selected. For instance, if the activity selected is "Play CDs", the soft button 140*a* is labeled "Disks" in one embodiment if a multi-disc player is part of the user's entertainment system. If the user only has a single disc CD player, then the button 140*a* is not usable/visible. More generally, in accordance with embodiments of the present invention, the function and appearance associated with a soft button depends on the context which includes several factors such as the mode the user is in (e.g., activities mode, device mode, options mode, etc.), the specific screen the user is in, the way the user's home entertainment system is set up and so on.

In one embodiment, there are pre-defined rules for the functionality that will be associated with the soft button. For instance, a rule could be implemented where the right soft button 140*b* is always "Devices" on any page under "Activities". The left soft button 140*a* could be context-dependent as described above. Another example of a rule that could be implemented is that for a "Device" page, the left soft button 140*b* displays the label that will return the user back to the previous screen displayed, as can be seen on 420.

It will be obvious to one of skill in the art that various context-specific buttons and/or precedence rules can be implemented in accordance with embodiments of the present invention.

Figure 4B:
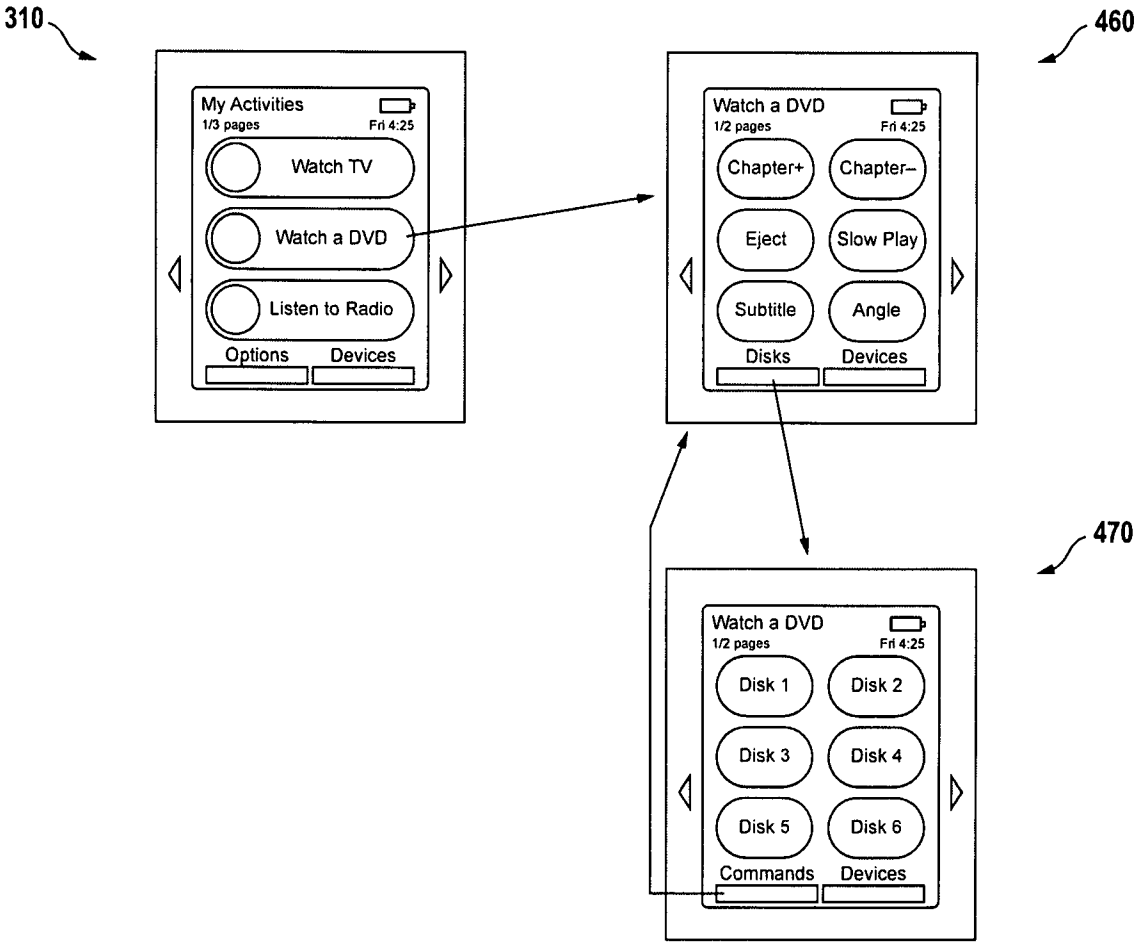
FIG. 4B provides another example of various possible screen navigation paths in accordance with an embodiment of the present invention.

FIG. 4B provides another example of various possible screen navigation paths in accordance with an embodiment of the present invention. Selecting the "Watch a DVD" activity on screen 310 will display screen 460 displaying commands for that activity. Pressing the "Disks" soft button 140*a* in screen 460 will display screen 470 showing the disks the user has in a multi-disk system. In one embodiment, if the system is not a multi-disk system, the soft button 140*a* will not be usable and/or visible. Pressing the "Commands" soft button 140*a* in screen 470 will take the user back to screen 460.

It will be obvious to one of skill in the art that there are several possible displays and configurations associated with a remote control in accordance with embodiments of the present invention, and that the displays described above are merely examples of these. These are not shown here because the specifics of these displays in no way limits the present invention.

Figure 4C:
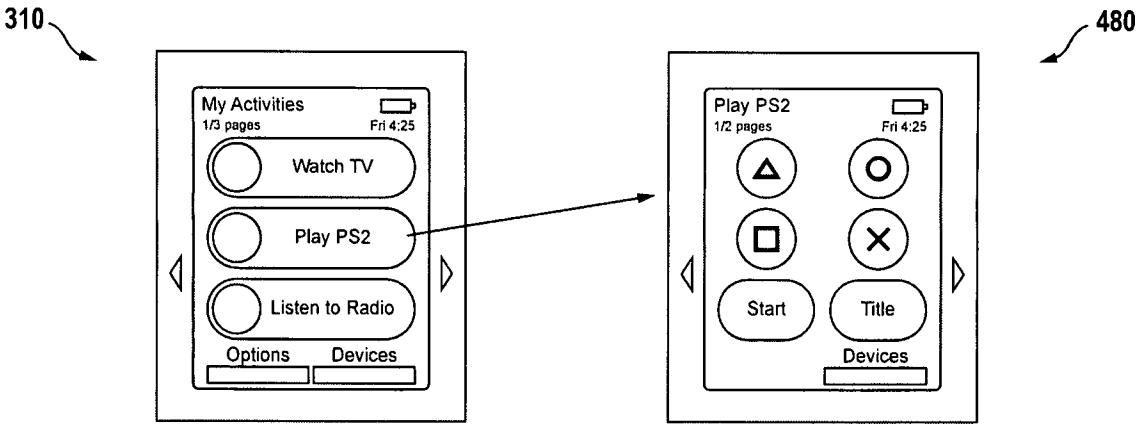
FIG. 4C provides yet another example of screen navigation paths in accordance with an embodiment of the present invention.

FIG. 4C illustrates a screen 480 which is displayed when the user selects an acivity "Play PS2". Screen 480 displays the commands associated with the "Play PS2" activity. In one embodiment, a remote control in accordance with an embodiment of the present invention can function as a game controller when the user is using a game console such as a Playstation from Sony, Xbox from Microsoft, Wii from Nintendo, and so on. It is to be noted that the remote control can take on several other roles not mentioned here, depending on the devices it is configured to control, the set-up of the user's home entertainment system, and so on.

Figure 5:
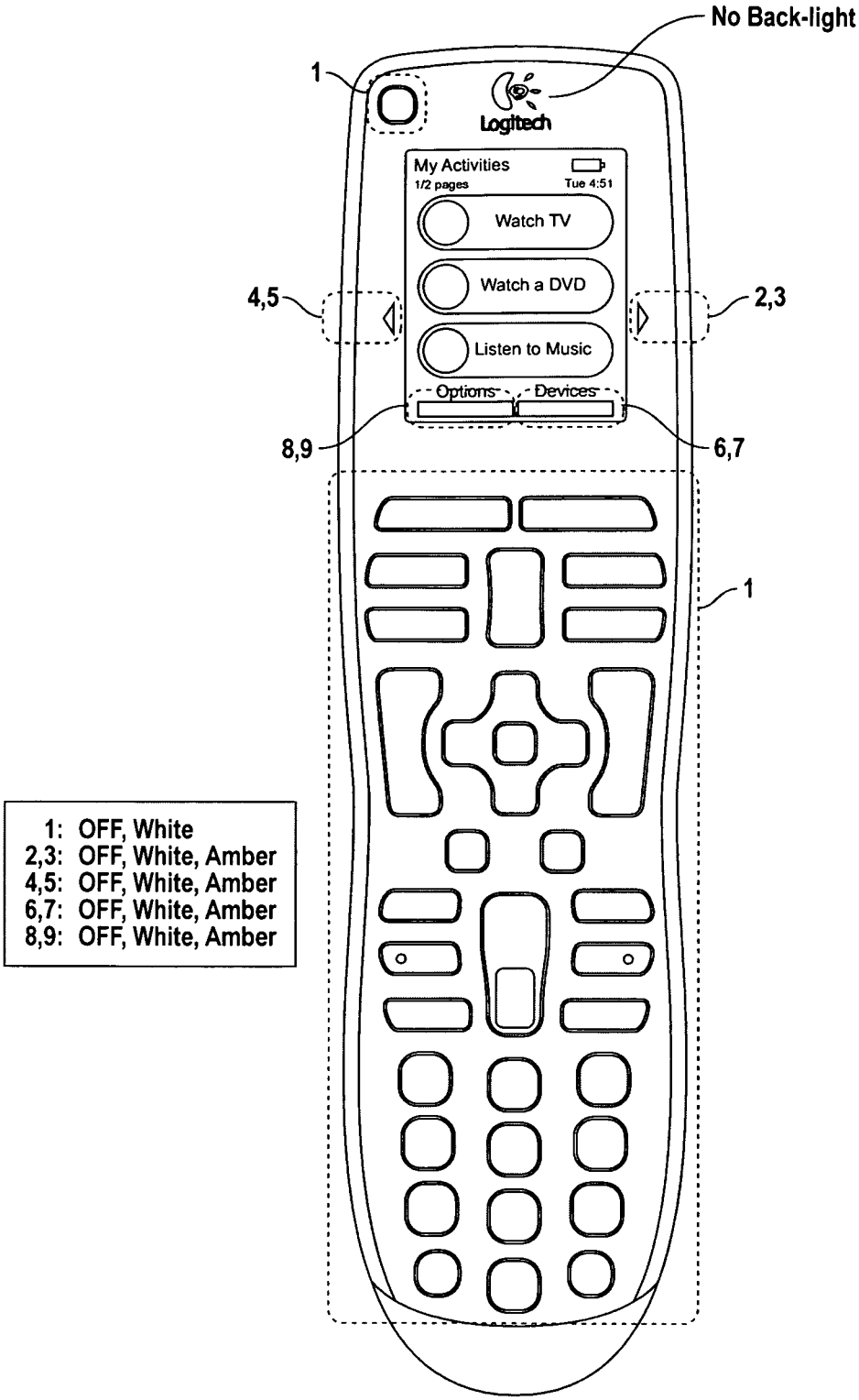
FIG. 5 shows some backlighting zones in accordance with an embodiment of the present invention.

As mentioned above, in one embodiment, one of the visual cues/indications available to the user is provided by backlighting of various buttons (soft and/or hard). This can be instead of, or in addition to, the color of the background and/or symbols on the LCD 110. FIG. 5 shows some backlighting zones in accordance with an embodiment of the present invention. In accordance with an embodiment of the present invention, the backlighting of one or more of these zones is context-dependent. Such context-dependent backlighting provides the user with visual cues/indications.

As has been seen above, in one embodiment, the remote control 100 has three modes: (i) an activity mode (associated with the "Activities" screen discussed above), (ii) a device mode (associated with the "Devices" screen discussed above), and (iii) an options (or settings) mode (associated with the "Options" screen discussed above).

Different modes are associated, in one embodiment, with different background colors for the screen 110, and/or different backlighting for various zones. For instance, in one embodiment the activity mode is considered the preferred mode. In accordance with one embodiment, the background color of the LCD 110 is blue in the activities mode, and the soft buttons 140*a-d* are backlit in white when appropriate in this mode. The device mode, on the other hand, is not preferred, and the user is accordingly cautioned accordingly by making the background color of the LCD 110 amber, as well as by backlighting the soft buttons 140*a-d* in amber in this mode. Such visual cues increase user awareness by preventing the user from accidentally or non-consciously entering the device mode and making changes to specific devices.

One embodiment of backlighting is described in greater detail with reference to FIG. 5. When the remote control 100 is turned on, the backlighting for zone 1 comes on. In one embodiment, the "Off" (or "Power") button gets backlit first, and the remainder of the buttons in zone 1 get backlit after that. When the remote control 100 is idle for a predetermined amount of time, the backlight for zone 1 is turned off. In one embodiment, this predetermined amount of time is configurable by the user. In one embodiment, the remote control 100 is connectable to a host computer, and the user can use the host computer to configure the remote control 100. In one embodiment, the user communicates with a remote server (via the host computer) to configure the remote control.

In one embodiment, zones 2, 3, 4 and 5 are backlit when the soft buttons 140*c* and 140*d* included in these zones are usable, as discussed above. For instance, if a menu contains only one page, then the left and right arrows are not usable, and their backlighting is turned off to indicate this to the user. On the other hand, if a menu contains more than one page, the left and/or right arrows are backlit (depending on which page the user is currently viewing). As mentioned above, the backlighting color is dependent, in one embodiment, on the context. For instance, in one embodiment, when the remote control 100 is in the activities mode or the options/settings mode, the backlighting for zones 2-5 is in white color. This indicates to the user that the current mode is a preferred/safe mode. On the other hand, in one embodiment, when the remote control 100 is in the devices mode, the backlighting for zones 2-5 is in amber color. This indicates to the user that the current mode is not a preferred/safe mode, and that the user should use some caution when proceeding in this mode.

In one embodiment, when certain soft buttons are not usable, they are not visible at all. In another embodiment, when certain soft buttons are not usable, they are represented by dotted lines. It is to be noted that the particular contexts, representations, and colors used are simply examples of the concept that the user can be provided with context-dependent visual cues.

In one embodiment, zones 6, 7, 8 and 9 behave similarly to zones 2-5 described above. In one embodiment, the backlighting of specific soft buttons 140*a* and 140*b* in zones 6-9 is turned off when that button is not usable. Further, when a soft button 140*a* and/or 140*b* is usable and the backlighting for that button is on, then the color of the backlighting is dependent on the context (e.g., whether the device is in activity mode, options/settings mode or device mode).

The assignee of the present invention operates a system for programming remote control devices to operate media systems wherein the user informs the system, via a user interface (e.g., a web page), of the devices they wish to control and the system assembles a configuration data set comprising the necessary infrared control signals and associated commands and programs which is then downloaded, through the Internet, into the remote control to configure it to operate the media system. The on-line configuration system is described in co-pending application Ser. No. 10/839,970, entitled "Online Remote Control Configuration System", which is herein incorporated by reference in its entirety. The information downloaded into the remote control is stored in a remote database, which is continually updated based upon input from other users as well. The functioning of the database, and uploading and downloading of information from this database is described in co-pending application Ser. No. 11/199,922, entitled "Method and Apparatus for Uploading and Downloading Remote Control Codes" which is herein incorporated by reference in its entirety.

Several aspects of the embodiments described above can be configured using such an on-line configuration system, and significant portions of relevant information can be downloaded from the database. For instance, the mapping of specific functions onto soft-buttons is dependent on the specific configuration of the user's home entertainment system (the devices included therein, their interaction, and so on). Such mapping can be downloaded, in one embodiment, from the remote database.

Figure 6:
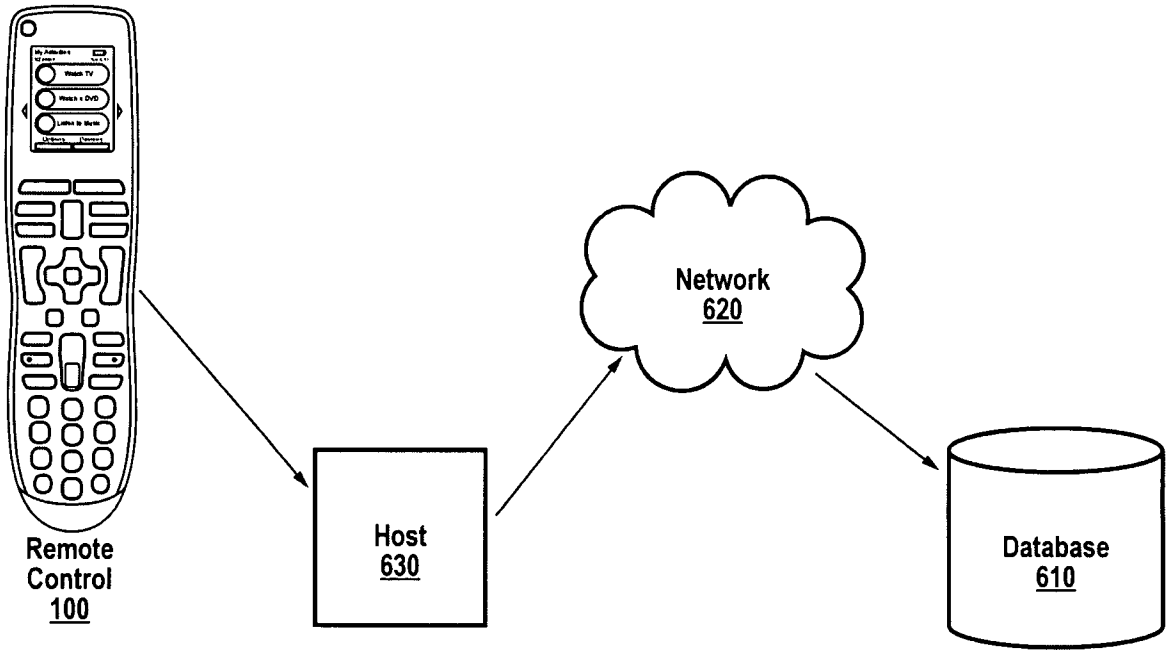
FIG. 6 is a block diagram of a system used to configure the remote control in accordance with an embodiment of the present invention.

Such a configuration in accordance with an embodiment of the present invention is illustrated in FIG. 6. FIG. 6 includes a remote control 100, a database 610, a network 620, and a host 630.

In one embodiment, the host 630 is a conventional computer system, that may include a computer, a storage device, a network services connection, and conventional input/output devices such as, a display, a mouse, a printer, and/or a keyboard, that may couple to a computer system. The computer also includes a conventional operating system, an input/output device, and network services software. In addition, the computer includes a network service connection which includes those hardware and software components that allow for connecting to a conventional network service. For example, the network service connection may include a connection to a telecommunications line (e.g., a dial-up, digital subscriber line ("DSL"), a T1, or a T3 communication line). The host computer, the storage device, and the network services connection, may be available from, for example, IBM Corporation (Armonk, N.Y.), Sun Microsystems, Inc. (Palo Alto, Calif.), or Hewlett-Packard, Inc. (Palo Alto, Calif.). It is to be noted that the host 630 can be any computing device capable of functionalities described herein, such as, but not limited to, gaming consoles, Personal Digital Assistants (PDAs), cell-phones, and so on.

In one embodiment (shown), the user connects the remote control 100 to the host 630, and the remote control 100 communicates with the database 610 via the host through a network 620. It is to be noted that the communication between the remote control 100 and the host 630 can occur via a wired link (e.g., USB), wireless link (e.g., direct wireless link, via a wireless home network, and so on). It is to be noted that in this or other embodiments, the remote control 100 does not need to connect to a host to communicate with the remote database, but rather can use the network 620 directly. For instance, the remote control 100 may be equipped to use an in-home wireless network, which may in turn communicate with an external network. An Ethernet connection, a communication with a cell-phone, and so on, may be used by the remote control 100. It will be obvious to one of skill in the art that any wired or wireless connection may be used by the remote control to communicate with the database 630.

The network 620 can be any network, such as a Wide Area Network (WAN) or a Local Area Network (LAN), or any other network. A WAN may include the Internet, the Internet 2, and the like. A LAN may include an Intranet, which may be a network based on, for example, TCP/IP belonging to an organization accessible only by the organization's members, employees, or others with authorization. A LAN may also be a network such as, for example, Netware™ from Novell Corporation (Provo, Utah) or Windows NT from Microsoft Corporation (Redmond, Wash.). The network 620 may also include commercially available subscription-based services such as, for example, AOL from America Online, Inc. (Dulles, Va.) or MSN from Microsoft Corporation (Redmond, Wash.). The network 120 may also be a home network, an Ethernet based network, a network based on the public switched telephone network, a network based on the Internet, or any other communication network. Any of the connections in the network 620 may be wired or wireless.

It is to be noted that in accordance with an embodiment of the present invention, the users can select different themes, which allow for a slightly different look and feel to the buttons, LCD, and so on.

While particular embodiments and applications of the present invention have been illustrated and described, it is to be understood that the invention is not limited to the precise construction and components disclosed herein. Various other modifications, changes, and variations which will be apparent to those skilled in the art may be made in the arrangement, operation and details of the method and apparatus of the present invention disclosed herein, without departing from the spirit and scope of the invention as defined in the following claims.

What is claimed is:

1. A remote control having a housing with a bottom surface and a top surface, the remote control comprising:

a display device including a physical screen and configured to display a plurality of interface controls on the screen;

a transparent covering placed on top of the display device substantially level with the top surface; and a touch-sensitive pad placed beneath the transparent covering, wherein the touch-sensitive pad is larger than the screen so that the touch-sensitive pad is responsive to touching directly on top of the screen as well as by touching areas of the top surface of the remote control beyond an outer perimeter of the screen.

2. The remote control of claim 1, further comprising:

a plurality of user input elements, wherein each of the plurality of user input elements is coupled to the touch-sensitive pad, and wherein a first part of each of the plurality of user input elements is on the screen, and a second part of each of the plurality of input elements is on a part of the touch-sensitive pad that is outside of the outer perimeter of the screen.

3. The remote control of claim 2, wherein the functionality of at least one of the plurality of user input elements changes based on a state of the remote.

4. The remote control of claim 2, further comprising:

a second plurality of user input elements, wherein each of the second plurality of user input elements operates a mechanical switch.

5. The remote control of claim 1, wherein the touch-sensitive pad uses capacitive technology.

6. A method for providing a user with an intuitive user interface for a remote control system, the remote control system including a remote control device having a display device comprising a physical screen and a touch-sensitive pad that extends beyond an outer perimeter of the screen, and a plurality of user-input elements, wherein a first user-input element is on a part of the touch-sensitive pad that is outside of the outer perimeter of the screen, the remote control device capable of being in one of a plurality of modes, the plurality of modes including an activity mode, the method comprising:

assessing a mode in which the remote control device is; and when the assessment indicates that the remote control device is in the activity mode, modifying the appearance of an interface shown on the screen to enable user selection of an activity from a set of one or more activities corresponding to the activity mode, wherein, modifying the appearance of the interface includes changing an indicator on the screen to reflect a command change associated with the first user-input element.

7. The method of claim 6, wherein the mode is one of a group consisting of activity mode, device mode and options mode.

8. The method of claim 6, further comprising:

based upon the assessment, modifying the appearance of the interface to change a command indicator associated with the first user-input element.

9. The method of claim 6, wherein the one or more activities includes a watching television activity and wherein selection of the watching television activity enables use of the remote control to interact with the remote control device to control aspects of a manner in which television content is presented.

10. The method of claim 6, wherein the one or more activities includes a plurality of activities.

11. The method of claim 6, further comprising detecting a user selected activity and modifying the interface according to the user selected activity to enable use of the remote control device to control one or more external devices that participate in the user selected activity.

12. The method of claim 6, further comprising receiving user input to the touch-sensitive pad specifying an external device to be controlled by the remote control device and putting the remote control device in a mode that enables the remote control device to control the external device.

13. The method of claim 6, wherein the plurality of user input elements include a user input element that, when selected by a user, causes the display to display the set of one or more activities.

14. The method of claim 6, wherein modifying the appearance of the interface includes causing the interface to include one or more icons, each of the one or more icons having a corresponding activity.

15. The method of claim 6, further comprising:

receiving selection of an activity from the set of one or more activities; and modifying the interface such that the remote control device simultaneously includes at least one or more user input elements for controlling a first device and one or more user input elements for controlling a second device, the first device and second device being devices that participate in the selected activity.

16. The method of claim 15, wherein at least one of the one or more user input elements for controlling the first device or one or more user input elements for controlling the second device is selectable via the display device.

17. The method of claim 16, wherein the mode is one of a group consisting of a plurality of modes in which the remote control device is capable of being and wherein, when the remote control is in at least one of the plurality of modes that is different from the activity mode, the remote control device does not include both the one or more user input elements for controlling a first device and one or more user input elements for controlling a second device simultaneously.

18. The method of claim 6, wherein the mode is in one of a group consisting of a plurality of modes in which the remote control device is capable of being and wherein the plurality of user-input elements change depending on the mode in which the remote control device is assessed to be.

19. A method of controlling a set of consumer electronic entertainment devices using a device usable as a remote control, the device having a display device configured to display a user interface, the display device including a physical screen, a touch-sensitive pad that extends beyond an outer perimeter of the screen, and a first user-input element that is at least partly on a part of the touch-sensitive pad that is outside of the outer perimeter of the screen, the method comprising:

causing the device to modify the interface shown on the screen to enable a user to select from a plurality of modes wherein:

the plurality of modes includes at least an activity mode;

the activity mode includes a plurality of activities that includes a watching television activity;

selection of the watching television activity enables use of the remote control to interact with the remote control device to control aspects of a manner in which television content is presented;

each activity involves the participation of a corresponding subset of the set of consumer electronic entertainment devices; and at least one of the corresponding subsets includes a plurality of the consumer electronic entertainment devices;

upon user selection of the activity mode, causing modification of the interface to enable user selection of an activity from a set of one or more activities corresponding to the activity mode;

upon user selection of an activity, causing modification of the display to include a set of user interface elements that are selectable by the user for controlling the one or more consumer electronic entertainment devices in the subset corresponding to the selected activity; and upon user selection of a user interface element from the included set of user interface elements, cause the device to transmit a signal such that, as a result of the signal being transmitted, at least one of the one or more consumer electronic entertainment devices in the subset corresponding to the selected activity modifies at least one aspect of participating in the selected activity, wherein at least one of selection of an activity and selection of a user interface element changes a command associated with the first user-input element and a corresponding display element on the screen associated with the first user-input element.

20. The method of claim 19, wherein the set of user interface elements simultaneously includes at least one or more user input elements for controlling a first device and one or more user input elements for controlling a second device, the first device and second device being devices that participate in the selected activity.

21. The remote control system of claim 19, further comprising:

causing the device to obtain information from a remote server that is accessible over the Internet; and wherein modification of the interface depends at least in part on the obtained information.

22. The remote control system of claim 19, wherein modifying the interface to enable a user to select from the plurality of modes includes causing the interface to present a plurality of icons in a sequence, each of the plurality of icons being selectable for selection of a corresponding activity.

23. The remote control system of claim 19, wherein the first user-interface element comprises an area that is inside the outer perimeter of the screen and an area that is outside the outer perimeter of the screen.

* * * * *